US005240508A

United States Patent [19]

Gwilliam

[11] Patent Number: 5,240,508

[45] Date of Patent: Aug. 31, 1993

[54] METHOD OF REMOVING ASBESTOS BY INSERTING A HOLLOW NEEDLE HAVING A CLOSED POINTED END

[76] Inventor: Graham J. Gwilliam, Clements End Green, Coleford, United Kingdom

[21] Appl. No.: 689,758

[22] PCT Filed: Dec. 4, 1989

[86] PCT No.: PCT/GB89/01449

§ 371 Date: May 21, 1991

§ 102(e) Date: May 21, 1991

[87] PCT Pub. No.: WO90/06191

PCT Pub. Date: Jun. 14, 1990

[30] Foreign Application Priority Data

Dec. 3, 1988 [GB] United Kingdom ..... 8828323

[51] Int. Cl.[5] ..... B08B 3/00; B08B 9/02

[52] U.S. Cl. ..... 134/34; 134/22.11; 134/22.14; 134/36; 134/42

[58] Field of Search ..... 134/34, 36, 24, 22.11, 134/22.12, 22.14, 21

[56] References Cited

U.S. PATENT DOCUMENTS

| | | | |
|---|---|---|---|
| 1,756,582 | 4/1930 | Butler | 239/271 |
| 2,548,621 | 4/1951 | Rutledge | 239/271 |
| 4,264,993 | 5/1981 | Freeman et al. | 8/149 |
| 4,626,291 | 12/1986 | Natale | 134/21 |
| 4,803,771 | 2/1989 | Lyons | 134/42 |
| 4,872,920 | 10/1989 | Flynn et al. | 134/21 |
| 4,908,068 | 3/1990 | Pittman et al. | 134/42 |

*Primary Examiner*—Theodore Morris
*Assistant Examiner*—Saeed T. Chaudhry
*Attorney, Agent, or Firm*—Young & Thompson

[57] ABSTRACT

The apparatus comprises one or more hollow needles 10 for insertion into asbestos to be removed and a source of pressurised liquid connected to the inside of the or each needle. The or each needle has a maximum cross-sectional dimension which is not greater than 4 mm, a closed pointed end 12 and a peripheral wall provided with one or more apertures 13 for discharging liquid fed to the inside of the needle into the asbestos to be removed.

10 Claims, 4 Drawing Sheets

METHOD OF REMOVING ASBESTOS BY INSERTING A HOLLOW NEEDLE HAVING A CLOSED POINTED END

This invention relates to apparatus for use in and a method of removing asbestos from surfaces to be stripped.

As is well known, asbestos dust is extremely dangerous to human beings and strict regulations govern the removal of asbestos from surfaces to be stripped.

Asbestos stripping takes place in sealed enclosures and normally the asbestos insulation is saturated with water or other liquid before stripping. Conventionally, in order to saturate the asbestos, the surface of the asbestos insulation is first broken open and the asbestos is then sprayed, often for several hours. Both the breaking open of the insulation and the action of the spray or liquid jet hitting the insulation creates airborne dust which could be harmful to an operative even when a respirator is worn.

According to one aspect of the invention, there is provided apparatus for use in removing asbestos, the apparatus comprising at least one hollow needle having a maximum cross-sectional dimension which is not greater than 4 mm, a closed pointed end and a peripheral wall provided with one or more apertures for discharging liquid fed to the inside of the needle into the asbestos to be removed, and means for supplying liquid under pressure to the inside of the needle.

Preferably, the or each needle is of circular cross-section and typically, the or each needle has an outside diameter of 2.5 mm or less.

Preferably, the or each needle has a plurality of apertures distributed around its periphery and, if the needle is long, also along the length of the needle.

Advantageously, the or each aperture extends outwardly through the peripheral wall of the needle in a rearwardly inclined direction to minimise the risk of becoming blocked as the needle is inserted into the asbestos.

Preferably, the apparatus comprises a plurality of needles supplied from a common source of pressurised liquid and in this case, conveniently, an individual flow control valve is associated with each needle.

According to another aspect of the invention, there is provided a method of removing asbestos from a surface to be stripped, the method comprising the steps of inserting at least one hollow needle having a closed pointed end and a maximum cross-sectional dimension of 4 mm into the asbestos, injecting liquid into the asbestos through one or more apertures in the peripheral wall of the needle, the liquid being supplied to the or each needle under pressure, and subsequently stripping the insulation from said surface.

Conveniently, the injection of liquid into the asbestos takes place as a sealed enclosure is built around the surface to be stripped.

The invention will now be more particularly described, by way of example only, with reference to the accompanying drawings, in which:

BRIEF DESCRIPTION OF THE DRAWING

Referring to FIGS. 1 to 5 of the drawings, the apparatus shown therein comprises a plurality of injection units each comprising a hollow needle 10 and a flow control valve 11.

Figure 1:
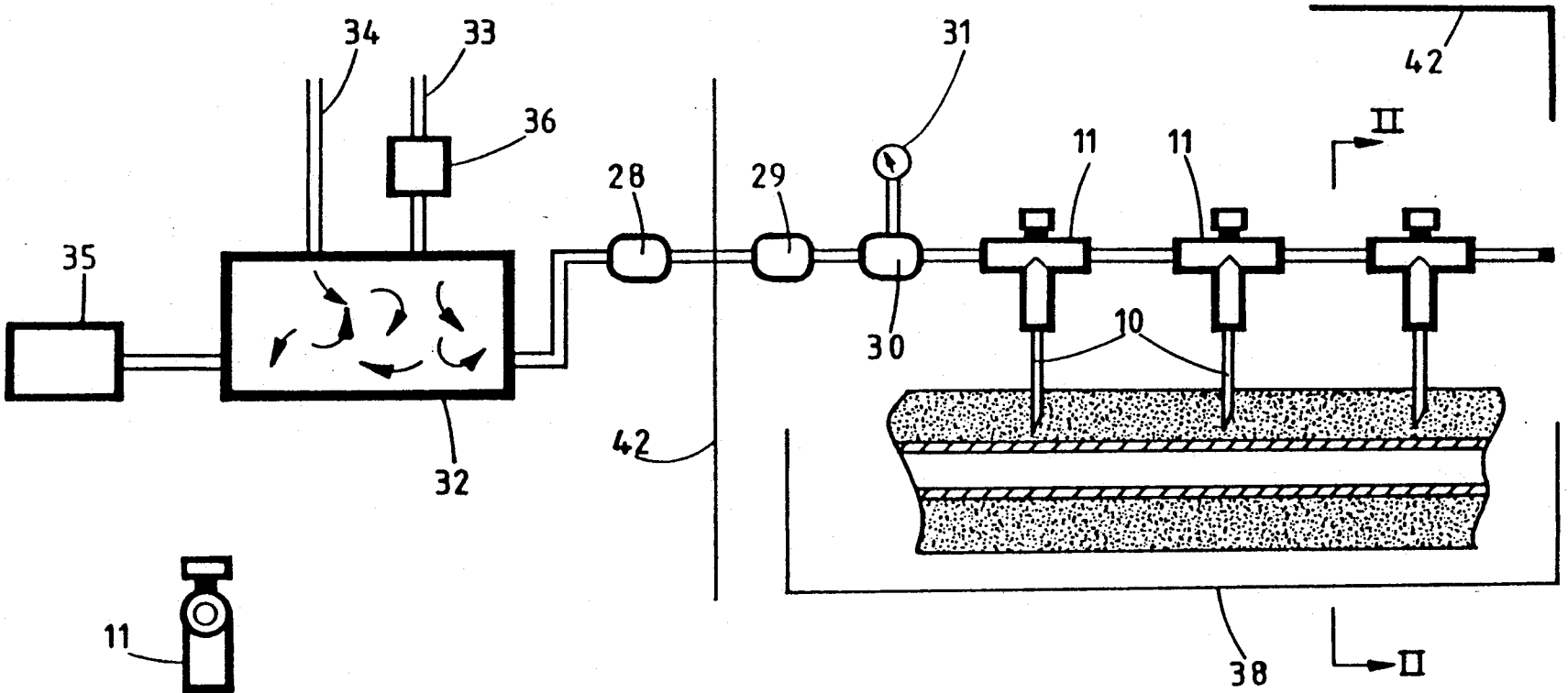
FIG. 1 is a schematic view showing one embodiment of apparatus according to the invention.
Figure 2:
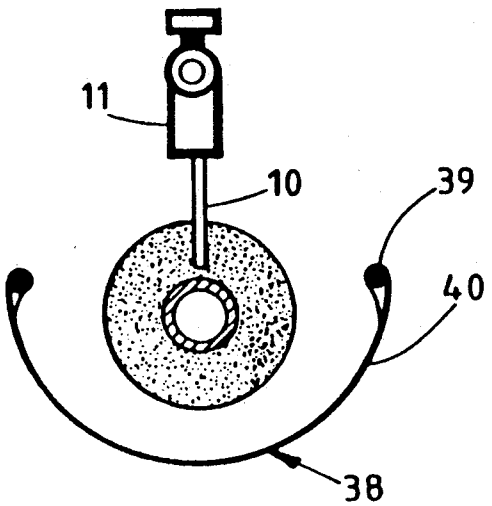
FIG. 2 is a section taken along line II—II of FIG. 1.
Figure 4:
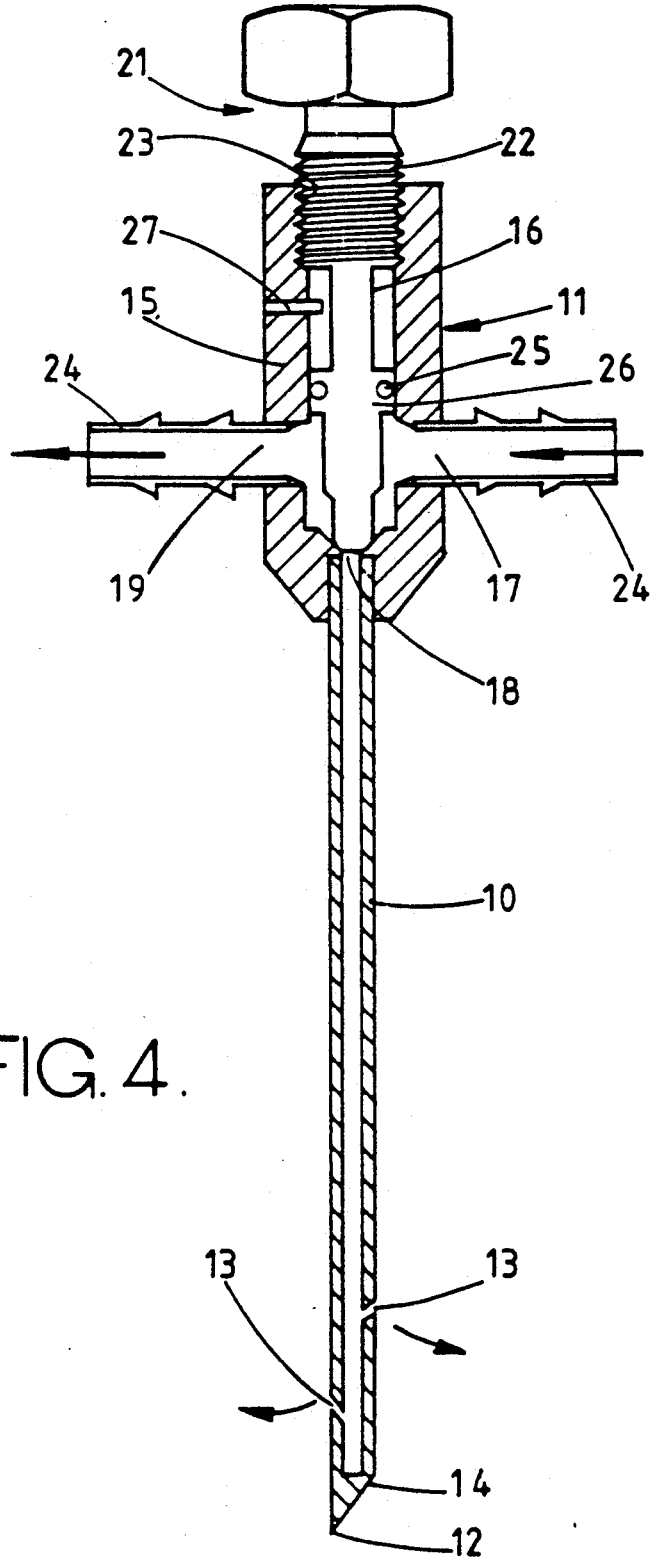
FIG. 4 is a sectional view of one of the injection units, on an enlarged scale.
Figure 5:
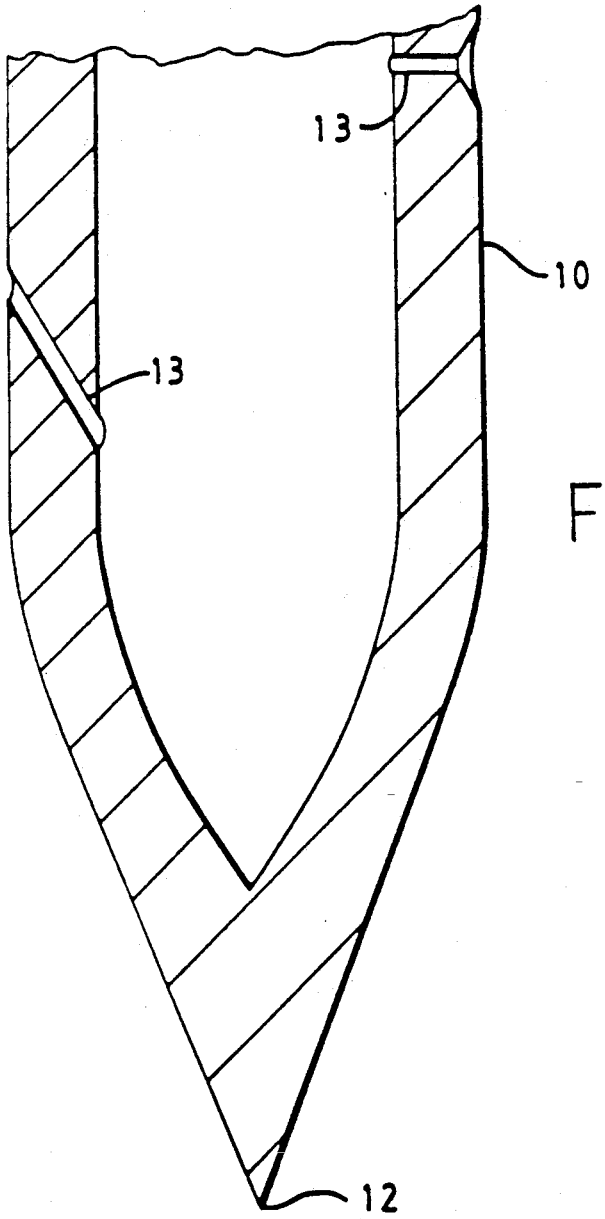
FIG. 5 is a sectional view of part of a modified needle on an even larger scale.

As best shown in FIGS. 4 and 5, each needle 10 has a closed pointed end 12 for insertion into asbestos insulation to be stripped from a surface, e.g. a pipe, and at least one, but preferably two or more apertures 13 distributed around the periphery of the needle for injecting liquid fed to the inside of the needle by the control valve 11 into the asbestos. The The pointed end 12 could be at the tip of an oblique ellipsoidal end surface 14 as shown in FIGS. 1 and 4, but alternatively the end of each needle may be swaged to a point 12 as shown in FIG. 5. The apertures 13 are preferably slanted away from the pointed end 12 as shown in FIG. 4 and on the left side of FIG. 5 to prevent blockage when penetrating the asbestos, but alternatively the apertures could be radial and the discharge ends of the apertures could be flared as shown on the right side of FIG. 5.

The needles 10 are preferably formed of stainless steel to avoid corrosion and the apertures 13 are formed by spark erosion or drilling.

Typically, the outside diameter of each needle 10 is about 2.5 mm and the apertures 13 typically have a diameter of between 5 and 30 thou. (0.127 mm to 0.762 mm) and typically about 0.30 mm, but in any event the needle (i.e. the part which is to penetrate the asbestos) should have a maximum cross-sectional dimension which is not greater than 4 mm as anything larger could damage or disturb the surface of the asbestos to an extent that releases harmful fibres.

The length of each needle 10 can range from about 20 mm for stripping small pipes having a thin insulation layer to in excess of 0.4 meters for sprayed asbestos surfaces. Longer needles have apertures 13 which are distributed not only around the needle periphery but also along the length of the needle.

Each flow control valve 11 comprises a valve body 15 defining a chamber 16 having a fluid inlet port 17, a fluid outlet port 18 and a fluid transfer port 19. The control valve 11 also comprises a valve member 20 which co-operates with a valve seat around the outlet port 18 to control the flow of liquid to the inside of the needle 10. The valve member 20 is integral with a valve operating member 21 having an externally threaded portion 22 which co-operates with an internally threaded portion 23 at the end of the chamber 16 remote from the outlet port 18. The chambers 16 of the flow control valves 11 are connected in series by connecting the fluid transfer port 19 of one valve 11 to the inlet port 17 of a downstream valve 11, the final valve 11 having its fluid transfer port 19 plugged. The valves 11 are connected together by flexible tubing which is push fittable on nipples 24 communicating with the ports 17 and 19 of each valve so that any required number of valves 11, together with associated needles, may be readily connected together. An 'O'-ring seal 25 is provided in an annular groove in a collar 26 integral with the valve member 20 and a pin 27 projects into the chamber 16 above the collar 26 to hold the valve member 20 captive relative to the valve body 15.

Pressurised liquid is supplied to the chambers 16 of the flow control valves 11 via a non-return valve 28, an isolating valve 29 and a pressure regulator 30 equipped with a pressure gauge 31.

The pressurized liquid may be mains water, but preferably is a mixture of mains water and a surfactant. A mixture of water and "Astrip"—a liquid developed by B. P. Chemicals Limited of Hythe, Southampton, England, has been found to be particularly suitable. The liquid is supplied from a variable pressure source which, as shown, comprises a pressure vessel 32 supplied with water and "Astrip" through respective pipes 32 and 34, and with gas, e.g. air, under pressure from a compressor 35. The water is filtered by filter 36 to remove particles which may otherwise block the needles 10.

In use, the needles 10 are pushed into the insulation at appropriately spaced apart positions. Some applications require the needle spacing to be as little as 50 mm; in other applications the needle spacing may be as great as 300 mm. The relatively small needle diameter coupled with the pointed ends 12 makes it possible for the needles to penetrate the asbestos without damaging or disturbing the surface of the asbestos to an extent that harmful fibres are released.

After the needles 10 have been inserted in the asbestos, the pressurized liquid is supplied to the needles through the control valves 11, and the flow rate is adjusted so that sufficient liquid is able to permeate into the asbestos without local flooding. Typically, the pressure in the chambers 16 of the control valves 11 is about 2 bar and the pressure within each needle is about 0.3 bar.

Figure 3:
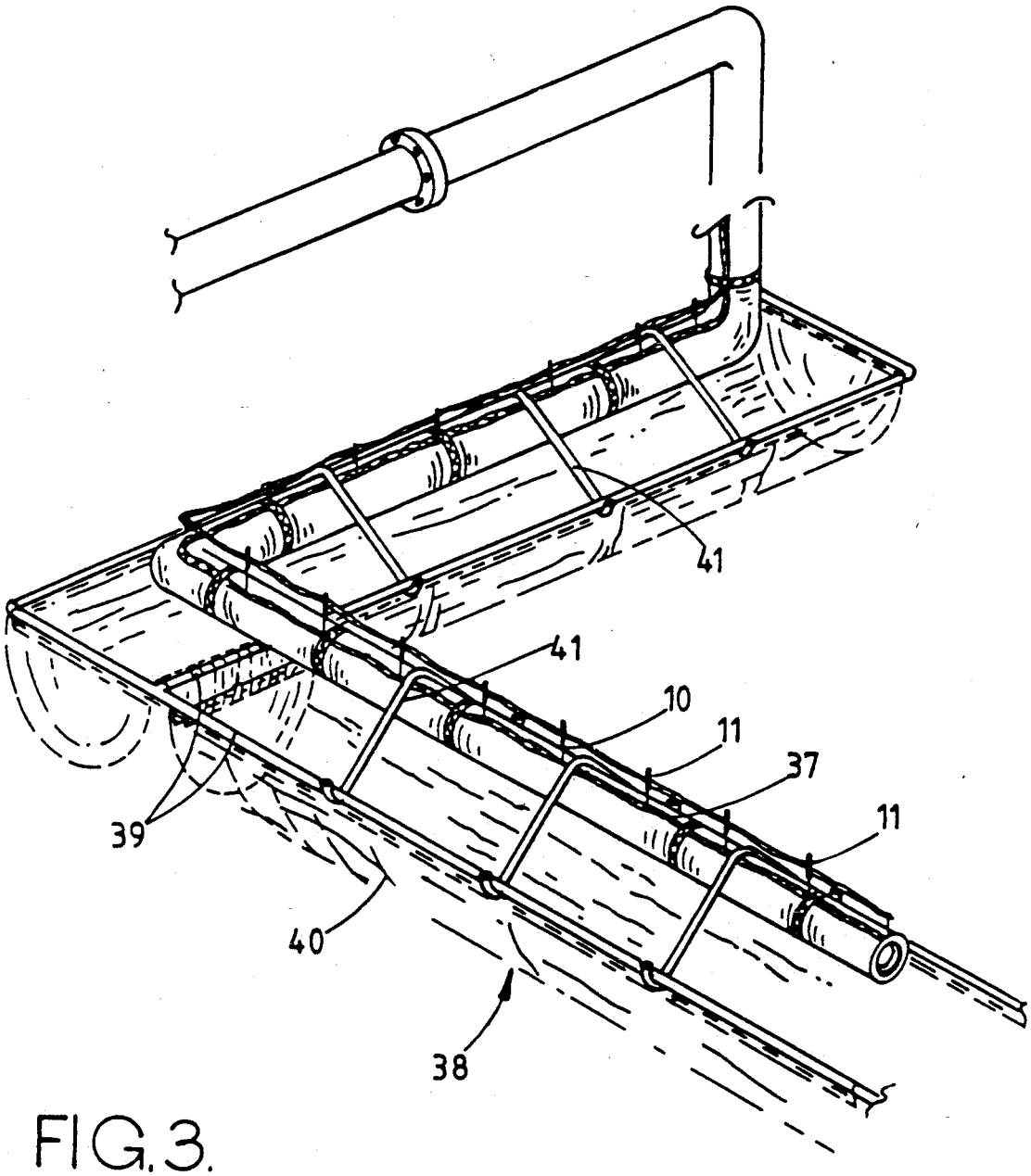
FIG. 3 is a perspective view of part of the apparatus of FIGS. 1 and 2.

When injecting asbestos on pipes, particularly horizontal pipes, it has been found advantageous to encase the pipes in polythene or other liquid impervious material 37 (shown in FIG. 3) to prevent leakage.

In addition or as an alternative to encasing the pipes in liquid impervious material, catchment troughs 38 (also shown in FIG. 3) may be suspended from the pipes to catch any liquid dripping from the pipes. The troughs 38 each comprise a framework structure 39 assembled on site, a polythene sheet 40 supported by the framework structure 39, and suspension members 41 which rest on top of the pipes and suspend the framework structure 39 and sheet 40 therefrom.

A sealed enclosure 42 is erected around the surfaces to be stripped with the isolating valve 29 and pressure regulator 30 within the enclosure 42 so as to be accessible to an operative working in the enclosure. However, as the injection process releases no harmful fibres, it is not necessary to erect the sealed enclosure prior to injection. The sealed enclosure can therefore be erected whilst the injection process is taking place and this provides significant economies in time and cost.

After the injection process is complete and a sealed enclosure has been erected, the asbestos is removed and caught in troughs 38 (if provided) and then disposed of in conventional manner.

Figure 6:
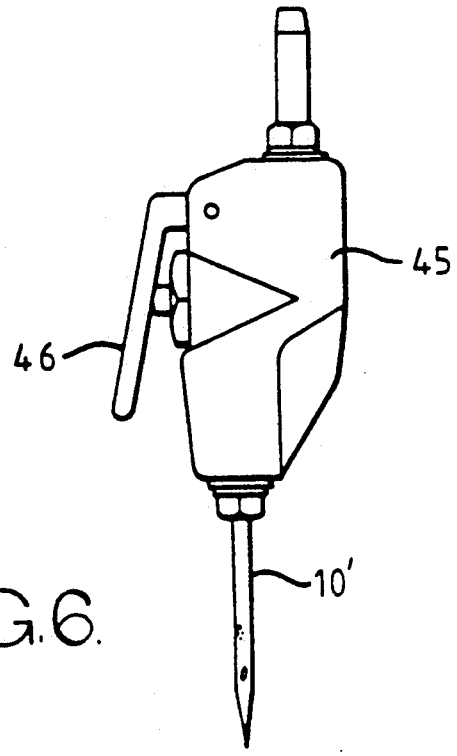
FIG. 6 is a side view showing part of a further embodiment of apparatus according to the invention.

In an alternative embodiment, the apparatus may, as shown in FIG. 6, comprise a single injection unit having a needle 10' and an associated flow control valve 45. In this case, liquid may be supplied to the needle from a container (not shown) pressurised by an manually operable pump and the control valve 45 may have a manually operable lever 46 for controlling the flow of liquid to the needle 10'. This apparatus is intended for use as a single unit for injecting small areas of asbestos or for sampling. In the latter case, a small area of asbestos to be stripped is saturated with water or other liquid using the single injection unit and asbestos can then be removed from the saturated area and sent for analysis.

The above embodiments are given by way of example only and various modifications may be apparent to persons skilled in the art without departing from the scope of the invention as defined in the appended claims. For example, it may be possible to dispense with the flow control valves 11, particularly if the apertures 13 in the needles 10 have a very small diameter, e.g. a diameter of about 5 thou (0.127 mm).

I claim:

1. A method of removing asbestos from a surface to be stripped, the method comprising the steps of:

(a) inserting at least one hollow needle having a closed pointed end and a maximum cross-sectional dimension of 4 mm into the asbestos, (b) wetting the asbestos by injecting liquid into the asbestos through one or more apertures in the peripheral wall of the needle, the liquid being supplied to the needle under pressure, said one or more apertures being spaced a distance from said pointed end, and subsequently.

(c) stripping the insulation from said surface.

2. A method as claimed in claim 1, wherein the liquid injected into the asbestos is water.

3. A method as claimed in claim 1, wherein the liquid injected into the asbestos is a mixture of water and surfactant.

4. A method as claimed in claim 1 wherein the method is used to strip asbestos from a pipe and wherein the pipe is substantially encased in a liquid impervious material during injection of liquid into the asbestos.

5. A method as claimed in claim 1, wherein the method is used to strip asbestos from a pipe and wherein a liquid catchment trough is suspended from the pipe during injection of liquid into the asbestos.

6. A method as claimed in claim 1 wherein a sealed enclosure is erected around the surface to be stripped as the injection of liquid into the asbestos takes place.

7. A method as claimed in claim 1, wherein the outside diameter of the needle is about 2.5 mm.

8. A method as claimed in claim 1, wherein said one or more apertures each has a diameter of about 0.30 mm.

9. A method as claimed in claim 1, in which the gauge pressure within said needle is about 0.3 bar.

10. A method as claimed in claim 1, there being a plurality of said needles in spaced parallel relationship, through which said liquid is simultaneously injected into the asbestos.

* * * * *